US009964920B2

(12) United States Patent
Yan et al.

(10) Patent No.: US 9,964,920 B2
(45) Date of Patent: May 8, 2018

(54) PROCESS CARTRIDGE AND PHOTOSENSITIVE DRUM DRIVING COMPONENT

(71) Applicants: Mei Yan, Xinyu (CN); Liangliang Hu, Xinyu (CN); Mingsheng Zhao, Xinyu (CN)

(72) Inventors: Mei Yan, Xinyu (CN); Liangliang Hu, Xinyu (CN); Mingsheng Zhao, Xinyu (CN)

( * ) Notice: Subject to any disclaimer, the term of this patent is extended or adjusted under 35 U.S.C. 154(b) by 0 days. days.

(21) Appl. No.: 15/258,192

(22) Filed: Sep. 7, 2016

(65) Prior Publication Data

US 2017/0146951 A1 May 25, 2017

(30) Foreign Application Priority Data

Nov. 21, 2015 (CN) ..... 2015 1 0806678
Jan. 19, 2016 (CN) ..... 2016 1 0033448

(51) Int. Cl.
*G03G 21/18* (2006.01)
*G03G 15/00* (2006.01)

(52) U.S. Cl.
CPC ..... *G03G 21/1857* (2013.01); *G03G 15/757* (2013.01)

(58) Field of Classification Search
None
See application file for complete search history.

(56) References Cited

U.S. PATENT DOCUMENTS 5,903,803 A 5/1999 Kawai et al.
6,035,159 A 3/2000 Azuma et al.
6,546,220 B1 4/2003 Asakura et al.
7,106,995 B2 9/2006 Nagai et al.
7,130,557 B2 10/2006 Abe et al.
7,630,624 B2 12/2009 Chang
8,090,296 B2 1/2012 Ito
(Continued)

FOREIGN PATENT DOCUMENTS

CN 2615707 Y 5/2004
CN 100353264 C 12/2007
(Continued)

OTHER PUBLICATIONS

Examination Report, Application No. 2017450, Netherlands Patent Office, dated May 15, 2017.
(Continued)

*Primary Examiner* — Thomas Giampaolo, II
(74) *Attorney, Agent, or Firm* — Steptoe & Johnson LLP

(57) ABSTRACT

A process cartridge, including a process cartridge housing, a photosensitive drum driving component, a driving force receiver, a flange component and a control mechanism. Opening parts are arranged on the driving force receiver and a retaining component is arranged on the process cartridge. When the control mechanism controls the driving force receiver to retract, the retaining component keeps the driving force receiver at a position non-interferential with a driving head of an image forming device. The driving force receiver and the flange component of the process cartridge are disengaged in a retracting state. In this state, the driving force receiving protrusion do not interfere with the front end column body of a machine driving head, and the process cartridge can be mounted and dismounted more smoothly.

14 Claims, 10 Drawing Sheets

(56) References Cited

U.S. PATENT DOCUMENTS

| | | | |
|---|---|---|---|
| 8,147,369 | B2 | 4/2012 | Marumoto et al. |
| 8,280,278 | B2 | 10/2012 | Ueno et al. |
| 8,437,669 | B2 | 5/2013 | Morioka et al. |
| 8,615,184 | B2 | 12/2013 | Zhou |
| 8,731,435 | B2 | 5/2014 | Xu |
| 9,170,549 | B2 | 10/2015 | Wang |
| 9,176,467 | B2 | 11/2015 | Gu |
| 2015/0093150 | A1 | 4/2015 | Xiao et al. |
| 2015/0177683 | A1 | 6/2015 | Gu et al. |

FOREIGN PATENT DOCUMENTS

| | | | |
|---|---|---|---|
| CN | 201532527 | U | 7/2010 |
| CN | 101846955 | A | 9/2010 |
| CN | 101907858 | A | 12/2010 |
| CN | 102466998 | A | 5/2012 |
| CN | 102141766 | B | 10/2013 |
| CN | 103439871 | A | 12/2013 |
| CN | 103454894 | A | 12/2013 |
| CN | 102200706 | B | 8/2014 |
| CN | 203786469 | U | 8/2014 |
| CN | 203894537 | U | 10/2014 |
| CN | 203950121 | U | 11/2014 |
| CN | 204009372 | U | 12/2014 |
| CN | 204116810 | U | 1/2015 |
| CN | 104516224 | A | 4/2015 |
| CN | 103376696 | B | 10/2015 |
| CN | 104991428 | A | 10/2015 |
| CN | 105319933 | A | 2/2016 |
| CN | 105549351 | A | 5/2016 |
| DE | 202010018322 | U9 | 8/2015 |
| EP | 2495619 | A1 | 9/2012 |
| EP | 2530532 | A1 | 12/2012 |
| EP | 2829919 | A1 | 1/2015 |
| JP | 2013518303 | A | 5/2013 |
| RU | 2547171 | C2 | 4/2015 |
| WO | 2011050613 | A1 | 5/2011 |
| WO | 2011091686 | A1 | 8/2011 |
| WO | 2015010538 | A1 | 1/2015 |
| WO | 2015043043 | A1 | 4/2015 |
| WO | 2015043339 | A1 | 4/2015 |

OTHER PUBLICATIONS

Examination Report, Application No. 1617707.3, Intellectual Property Office, dated Apr. 19, 2017.

Examination Report, Application No. 15258192, United States Patent and Trademark Office, dated Jul. 7, 2017.

PROCESS CARTRIDGE AND PHOTOSENSITIVE DRUM DRIVING COMPONENT

CROSS-REFERENCE TO RELATED APPLICATIONS

This application claims priority to Chinese Application No. 201510806678.3, filed Nov. 21, 2015; and Chinese Application No. 201610033448.2, filed Jan. 19, 2016, which are herein incorporated by reference in their entirety.

FIELD OF THE INVENTION

The present disclosure relates to a process cartridge photosensitive drum driving component.

BACKGROUND

A process cartridge for an imaging device can be detachably installed within a main frame of the imaging device and, as a whole unit, comprises a photosensitive assembly and at least one processing means such as charging means, developing means, cleaning means, or the like. The process cartridge is detachably installed within the main frame of the imaging device for convenience of maintenance. An electrophotographic imaging device functions in the following manner: an electrostatic latent image is formed by selectively exposing the electrophotographic photosensitive assembly which is uniformly charged by a charger under light from the imaging device; the electrostatic latent image is developed with a developing means using a toner into a toner image; the toner image thus formed is transferred onto a recording medium by a transferring means to form an image on a recording material.

Generally, a driving force receiving device is arranged on the photosensitive component of the process cartridge and is engaged with a machine driving device in the image forming device so as to drive the photosensitive component to rotate and drive the whole process cartridge to work. However, the photosensitive component needs to be detachably mounted in the image forming device together with the process cartridge, therefore, when the process cartridge is taken out of the image forming device, it is required that the driving force receiving device is disengaged from the machine driving device so as to ensure that the process cartridge can be smoothly taken out of the image forming device; and when the process cartridge is mounted into the image forming device to carry out printing operation, it is required that the driving force receiving device is engaged with the machine driving device so as to ensure that the photosensitive component smoothly receives driving force.

In the prior art, many manufacturers adopt an extendable driving force receiving device, and a control mechanism for controlling extending and retracting of the driving force receiving device is arranged at one side of the process cartridge to realize engagement between the driving force receiving device and a machine driving device when the process cartridge works and disengagement between the driving force receiving device and the machine driving device when the process cartridge is dismounted. In a recent application of a patent with the publication number of CN204044516 by the applicant, a process cartridge is disclosed, a control mechanism is arranged at one side of the process cartridge and is configured as a pressing rod. When the process cartridge is mounted in the image forming device, the pressing rod is matched with a rail of the image forming device so as to control the extending and retracting of the driving force receiving device. In order not to change the using habit of a customer, a jacking block is arranged at a side end of the process cartridge, and can automatically jack up the process cartridge when a door of the image forming device is opened, so as to control the driving force receiving device to retract, thus facilitating dismounting of the process cartridge from the image forming device. However, the above mentioned structure has the following defects: the extendable stroke of the extendable driving force receiving device is usually restricted by the stroke of the control mechanism, and under the condition that the extendable stroke of the driving force receiving device is restricted, as the rotary stopping position of the driving force receiver of the driving force receiving device is not restricted, when the process cartridge is mounted or dismounted, if the driving force receiving protrusion of the driving force receiver is roughly coincided with or parallel to the mounting direction, the driving force receiving protrusion may interfere with a driving head in the machine driving device, and the process cartridge cannot be normally mounted and dismounted. Therefore, it is urgent to develop a new process cartridge to solve the problems above.

SUMMARY

In order to solve the problems in the technical solution above, the present disclosure is implemented through the following technical solution. In general terms the present disclosure is directed to various embodiments of a process cartridge. In one embodiment, a process cartridge detachably mounted in an image forming device including a driving head includes a process cartridge housing, and a photosensitive drum driving component arranged at one side of the process cartridge housing. The photosensitive drum driving component includes a driving force receiver, which can be engaged with the driving head.

The photosensitive drum driving component also includes a flange component, wherein the driving force receiver can transfer driving force to the flange component. There is a control mechanism in the photosensitive drum driving component. The control mechanism receives external force of the image forming device to control the driving force receiver to extend and retract. When the control mechanism controls the driving force receiver to extend, the driving force receiver can transfer driving force to the flange component, and when the control mechanism controls the driving force receiver to retract, the driving force receiver can idle relative to the flange component.

Also, the photosensitive drum driving component includes a retaining component, which is arranged on the process cartridge and is configured to limit a rotary stopping position of the driving force receiver when the driving force receiver can idle relative to the flange component.

In one embodiment, a limiting part abutting against the retaining component is arranged on the driving force receiver, and the cross section of the limiting part is non-circular. The limiting part may include a protrusion part and an abutment part, wherein the protrusion part and the abutment part extend for different distances from the axis of the driving force receiver along the radial direction of the driving force receiver. The distance which the abutment part extends from the axis of the driving force receiver along the radial direction of the driving force receiver is shorter than the distance which the protrusion part extends from the axis of the driving force receiver along the radial direction of the driving force receiver. When the driving force receiver can idle relative to the flange component, the retaining component abuts against the abutment part to limit the rotary stopping position of the driving force receiver.

In one embodiment, driving protrusions are arranged on the driving force receiver, driving force transmission protrusions are arranged on the flange component, and both the driving protrusions and the driving force transmission protrusions include guide inclined planes. A plurality of the driving protrusions and a plurality of the driving force transmission protrusions are provided. The driving force transmission protrusions extend along a direction parallel to the axial direction of the flange component.

In certain embodiments, a first driving block and a second driving block are detachably arranged on the driving force receiver. The first driving block and the driving force receiver can rotate relative to each other. The first driving block is configured to receive the force which is from the control mechanism and is used for moving the driving force receiver in an extending-retracting direction. The second driving block and the driving force receiver are fixed in the rotation direction, and the second driving block is configured to transfer the driving force to the flange component. In one embodiment, the plurality of the driving force transmission protrusions are arranged on the second driving block. The retaining component may be a torsional spring in certain embodiments. When the driving force receiver rotates, the retaining component does not rotate synchronously with the driving force receiver.

In certain embodiments, the process cartridge may further include a holder. A locating column is arranged on the holder, and the retaining component is arranged on the locating column.

After adoption of the technical solution above, the driving force receiver and the flange component of the process cartridge in the present disclosure are disengaged in a retracting state, and the retaining component is arranged at the side end of the process cartridge and the limiting part is arranged on the driving force receiver. After the retaining component is matched with the limiting part and when the driving force receiver is in the retracting state, the driving force receiver, under the action of the retaining component, is always at a position non-interferential with a front end column body of a machine driving head. Thus, the process cartridge can be mounted and dismounted more smoothly.

DETAILED DESCRIPTION

In order to make the purposes, the technical solutions and the advantages of the embodiments of the present disclosure more clear, hereinafter, the technical solutions in the embodiments of the present disclosure will be described clearly and completely with reference to the accompanying drawings in the embodiments of the present disclosure. Apparently, the embodiments described are part of the embodiments of the present disclosure, but not all of the embodiments. Based on the embodiments in the present disclosure, all the other embodiments obtained by those of ordinary skilled in the art without creative works belong to the protection scope of the present disclosure.

Figure 1:
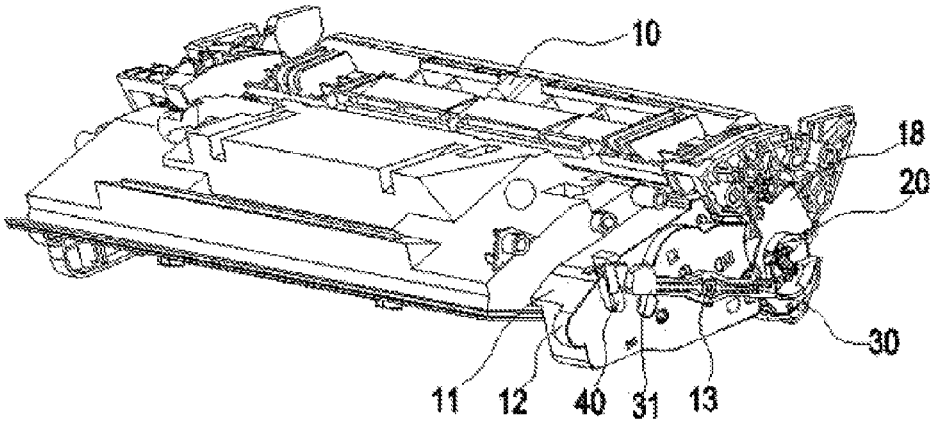
FIG. 1 is a schematic diagram of a process cartridge according to the present disclosure.

As shown in FIG. 1, the process cartridge provided by the present disclosure comprises a process cartridge housing 10, a photosensitive drum driving component 20 arranged at one side of the process cartridge housing 10, a control mechanism 30 for controlling a driving force receiver 21 (refer to FIG. 4) in the photosensitive drum driving component 20 to extend and retract, and a lifting mechanism 40 for lifting up the process cartridge housing 10. The photosensitive drum driving component 20 is supported on the process cartridge housing 10, and the control mechanism 30 and the lifting mechanism 40 are arranged at the same sides of the process cartridge housing 10 and the photosensitive drum driving component 20.

In this embodiment, the control mechanism 30 and the lifting mechanism 40 are supported by a side cover 11 arranged at one side of the process cartridge housing 10. The control mechanism 30 is configured as a pressing rod 31. A pivot column 13 is arranged on the side cover 11. The pressing rod 31 can rotate relative to the side cover 11 by taking the pivot column 13 as a pivot. The pressing rod 31 can control the driving force receiver 21 to extend and retract when is rotated by force (refer to FIG. 4).

Figure 2:
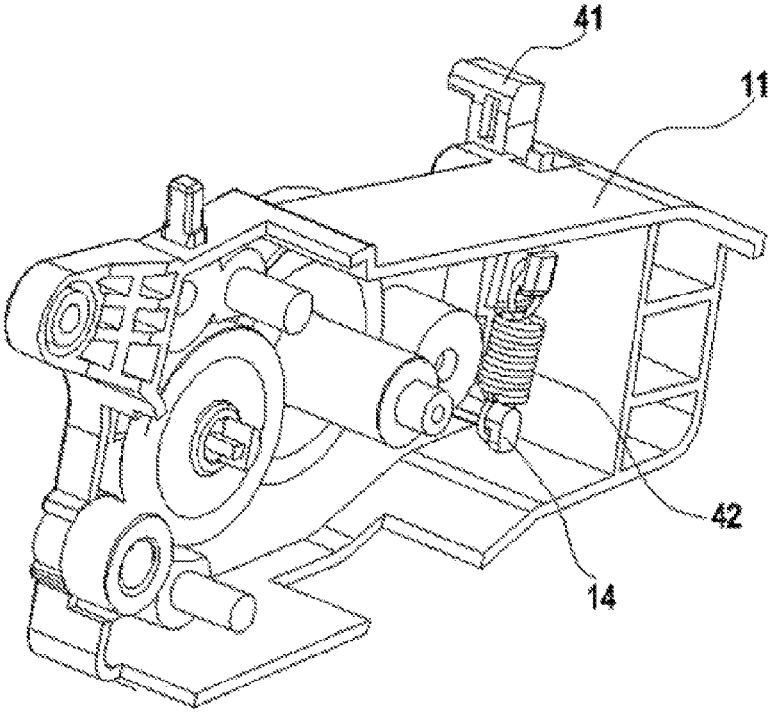
FIG. 2 is a schematic diagram of a lifting mechanism of the process cartridge according to the present disclosure.
Figure 3:
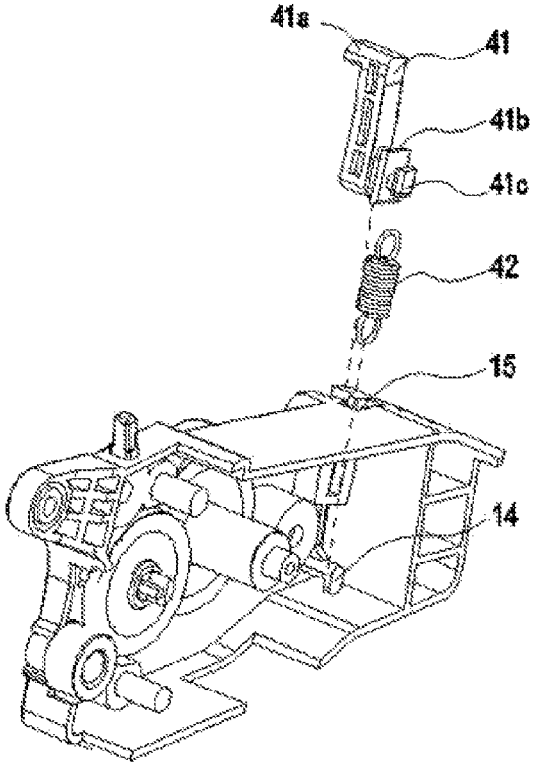
FIG. 3 is an exploded view of the lifting mechanism of the process cartridge according to the present disclosure.

As shown in FIGS. 2-3, the lifting mechanism 40 of the process cartridge provided by the present disclosure is arranged on the side cover 11, and the side cover 11 includes a locating slot 15, the lifting mechanism 40 comprises a pull rod 41 and a first elastic element 42, and the pull rod 41 includes an ear part 41*a*, a locating protrusion 41*b* and an end part 41*c*, the ear part 41*a* is protruded from the pull rod 41 along an axial direction Y parallel to the photosensitive drum driving component 20, and is configured to hook up a rail 102 of the image forming device during mounting of the process cartridge (refer to FIG. 8); the side cover 11 includes the locating slot 15 and a locating column 14, and the locating protrusion 41*b* is slidably arranged in the locating slot 15. In this embodiment, the first elastic element 42 is configured as a tension spring, one end of the tension spring is connected with the locating column 14, and the other end of the tension spring is connected with the end part 41*c*.

Figure 4:
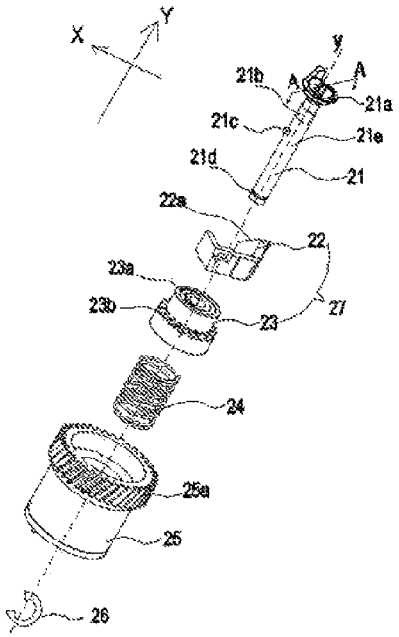
FIG. 4 is an exploded view of the driving component of the process cartridge according to the present disclosure.
Figure 11:
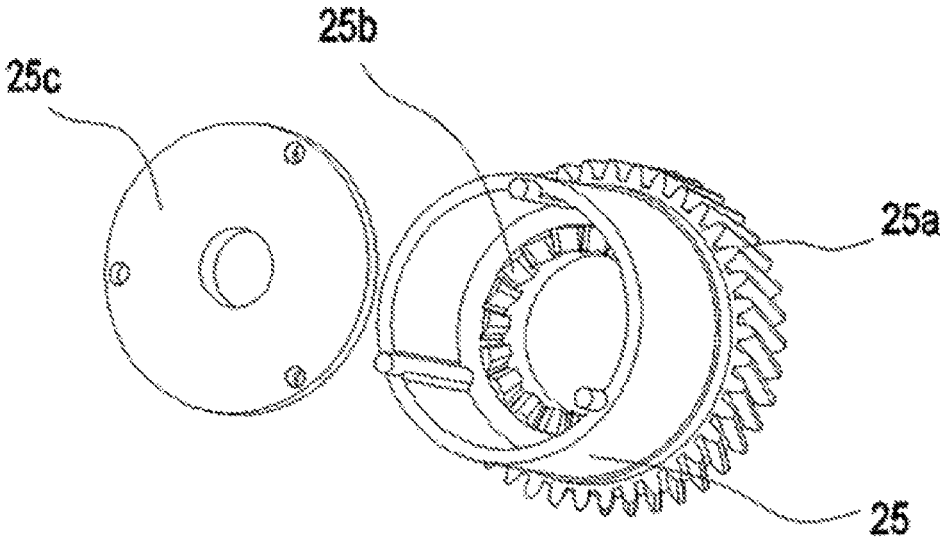
FIG. 11 is an exploded view of the flange component according to the present disclosure.

As shown in FIG. 4 and FIG. 11, the photosensitive drum driving component 20 comprises a driving force receiver 21, a driving part 27, a second elastic element 24 and a flange component 25. The driving force receiver 21 is engaged with a machine driving head 110, and at least one part of the driving force receiver 21 is extendably arranged in an inner cavity of the flange component 25.

A driving force receiving protrusion 21*a* and a connecting part 21*e* are arranged on the driving force receiver 21. The connecting part 21*e* is connected with the driving force receiving protrusion 21*a* and is configured as a rotating rod, and a limiting part 21*b*, an engagement protrusion 21*c* and a clamping slot 21*d* are arranged on the connecting part 21*e*. The driving force receiving protrusion 21*a* is configured to be engaged with the machine driving head 110 in the image forming device so as to receive driving force. The limiting part 21*b* is configured to be matched with the retaining component 19 (refer to FIG. 7) so as to control the mounting and dismounting positions of the driving force receiving protrusion 21*a*. The engagement protrusion 21*c* is protruded from the connecting part 21*e* along the radial direction of the connecting part 21*e*, and is configured to be engaged with an engaging groove 23*a* of a second driving block 23 so as to transfer driving force to the second driving block 23 and the clamping slot 21*d* is configured to be matched with a clamp spring 26 so as to restrict the extendable stroke of the driving force receiver 21.

The driving part 27 comprises a first driving block 22 and a second driving block 23. The first driving block 22 includes a pushed surface 22*a* and a mounting hole (not shown), the pushed surface 22*a* is configured as a cambered surface or an inclined plane and can be matched with the pressing rod 31 to receive force from the pressing rod 31 so as to control the extending and retracting of the driving force receiver 21, and the driving force receiver 21 passes through the mounting hole (not shown), therefore, the first driving block 22 does not rotate together with the driving force receiver 21. The second driving block 23 includes an engaging groove 23*a* and driving protrusions 23*b*, the engaging groove 23*a* is configured to be engaged with the engagement protrusion 21*c* so as to receive driving force of the driving force receiver 21, a plurality of driving protrusions 23*b* are arranged at intervals along the circumferential direction of the second driving block 23, and the driving protrusions 23*b* include guide inclined planes 23*b*1 which are configured to be engaged with driving force transmission protrusions 25*b* of the flange component 25 so as to transfer driving force to the flange component 25.

The second elastic element 24 is configured as a compression spring, one end of which abuts against the second driving block 23, and the other end of which abuts against the inner surface of the flange component 25. Therefore, under the action of the second elastic element 24, the driving force receiver 21 can extend and retract along its axial direction Y which is perpendicular to the mounting direction X of the process cartridge.

As shown in FIG. 11, a gear part 25*a* is arranged at the periphery of the flange component 25 and can transfer driving force to other driving force parts, a plurality of driving force transmission protrusions 25*b* are arranged in the inner cavity of the flange component 25, are similar to the driving protrusions 23*b* in structure, and are arranged at intervals along the circumferential direction of the flange component 25. The flange component 25 includes guide inclined planes, therefore, the driving protrusions 23*b* and the driving force transmission protrusions 25*b*, which are arranged alternately, can be engaged with each other to transfer driving force when getting contact at any angle under the guidance of the guide inclined planes, and the situation that the driving protrusions 23*b* and the driving force transmission protrusions 25*b* get stuck and cannot be engaged with each other is avoided. The flange component 25 also includes a bottom cover 25*c*, the bottom cover 25*c* and the flange component 25 are arranged separately, the bottom cover 25*c* is detachably arranged on the flange component 25 so as to cover a bottom end opening of the flange component 25, and this configuration can ensure that the second driving block 23 and the second elastic element 24 are arranged into the inner cavity of the flange component 25 from the bottom end opening of the flange component 25.

In this embodiment, both the driving protrusions 23*b* and the driving force transmission protrusions 25*b* include guide inclined planes, and it will be appreciated by those skilled in the art that in the preferred embodiment, the guide inclined planes are arranged on each of the driving protrusions 23*b* and the driving force transmission protrusions 25*b*, however, the guide inclined planes arranged on either of them also can guide them to finish engagement.

In this embodiment, the driving force receiver 21, after being assembled together with the driving part 27 and the second elastic element 24, is arranged into the inner cavity of the flange component 25 from the bottom opening of the flange component 25, and the clamp spring 26 is installed into the clamping slot 21*d*.

Figure 5A:
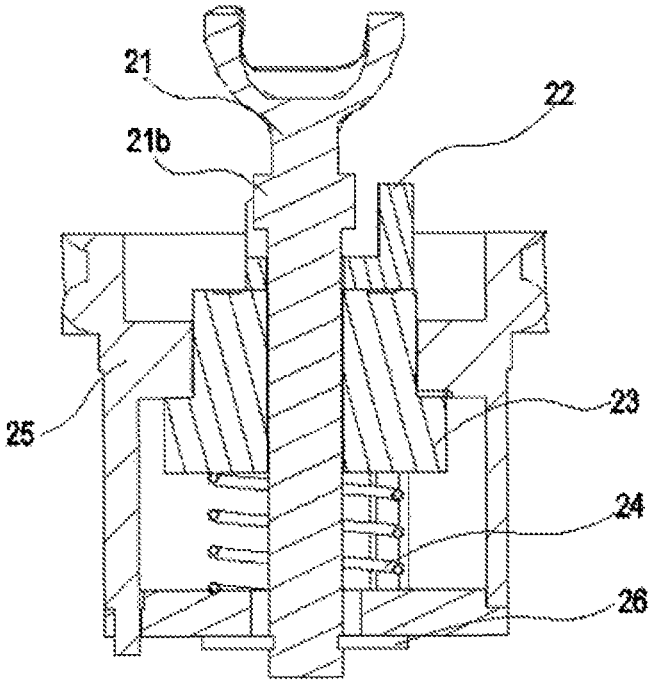
FIGS. 5A-5B are schematic diagrams of the driving component of the process cartridge in an extending state according to the present disclosure.
Figure 5B:
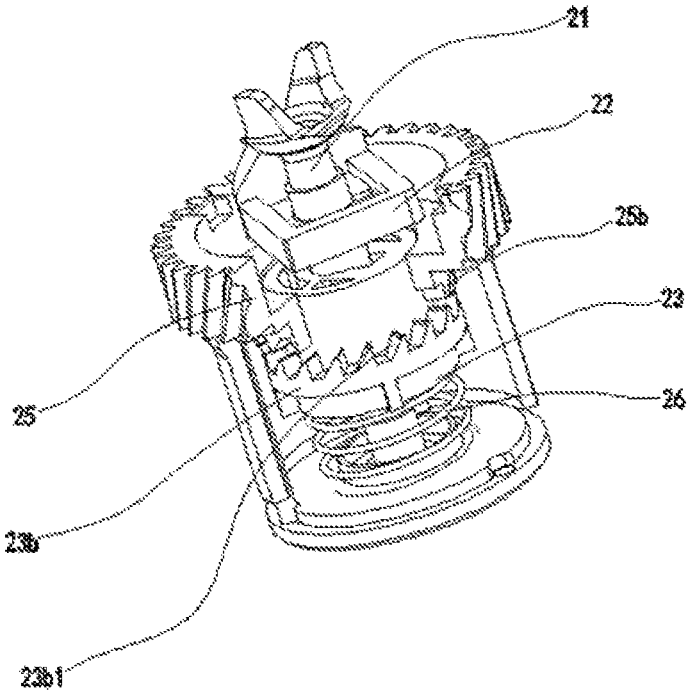

As shown in FIGS. 5A-5B, when the driving force receiver 21 of the process cartridge in the present disclosure is in an extending state under the action of the elastic force of the second elastic element 24, the driving protrusions 23*b* of the second driving block 23 are engaged with the driving force transmission protrusions 25*b* of the flange component 25, and at this moment, the driving force receiver 21 receives driving force and can drive the flange component 25 to rotate together.

Figure 6A:
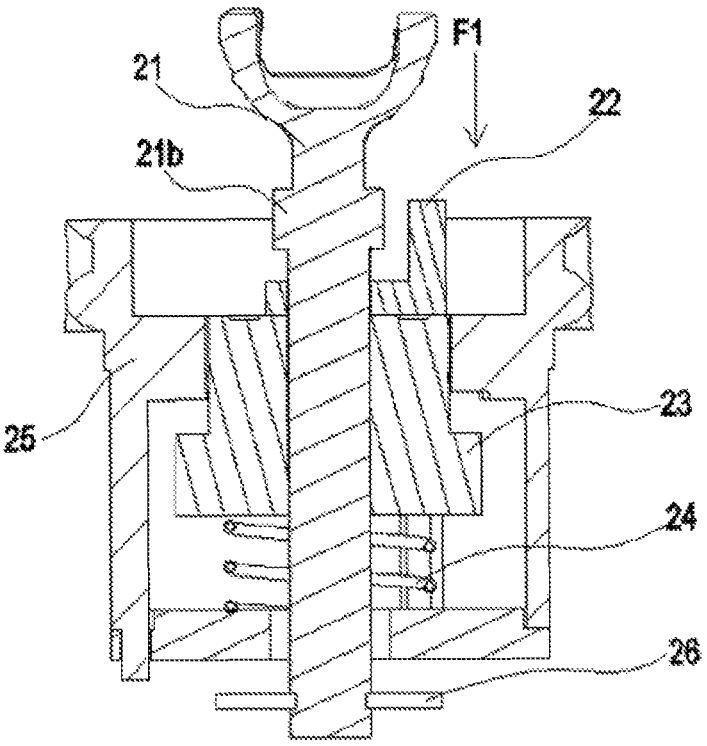
FIGS. 6A-6B are schematic diagrams of the driving component of the process cartridge in a retracting state according to the present disclosure.
Figure 6B:
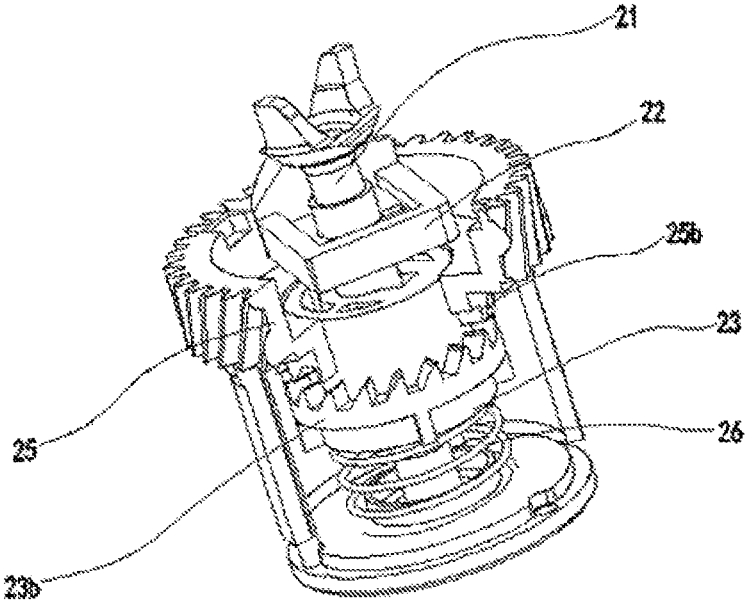

As shown in FIGS. 6A-6B, when the driving force receiver 21 of the process cartridge in the present disclosure is in a retracting state under the action of external force F1 of the pressing rod 31, the driving protrusions 23*b* of the second driving block 23 are disengaged with the driving force transmission protrusions 25*b* of the flange component 25, and at this moment, the driving force receiver 21 can idle relative to the flange component 25, that is, the driving force receiver 21 can rotate freely around its rotating shaft without driving the flange component 25 to rotate.

In this embodiment, the second driving block 23 and the driving force receiver 21 are arranged separately, the second driving block 23 is configured as a middle component, and the driving force receiver 21 can transfer a driving force to the flange component 25 by the middle component. It will be appreciated by those skilled in the art that the driving force receiver 21 and the second driving block 23 can also be configured as one component which is directly engaged with the flange component 25, to transfer the driving force to the flange component 25.

Figure 7:
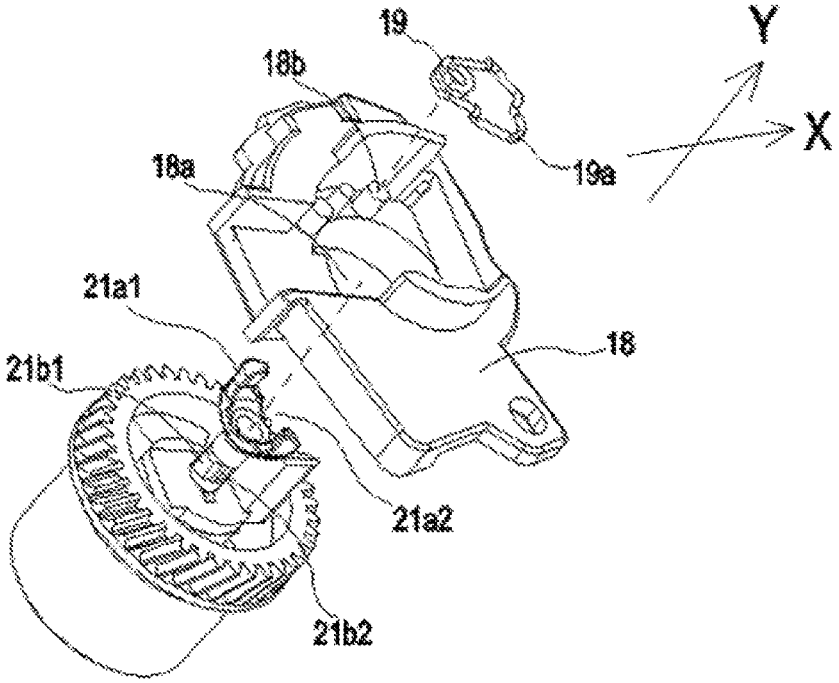
FIG. 7 is a view showing the matching of the driving component and a side cover of the process cartridge according to the present disclosure.

As shown in FIG. 1 and FIG. 7, a holder 18 is further arranged at a side end of the process cartridge and includes an opening 18*a* and a retaining component mounting part 18*b*. The driving force receiver 21 is configured to have at least one part positioned in the opening 18*a*, the retaining component mounting part 18*b* is configured as a positioning column, and the retaining component 19 is installed on the retaining component mounting part 18*b*.

As shown in FIG. 4 and FIG. 7, the driving force receiving protrusion 21*a* comprises jaw parts 21*a*1 and opening parts 21*a*2. The jaw parts 21*a*1 and the opening parts 21*a*2 are arranged alternately along the circumferential direction of the driving force receiver 21. The jaw parts 21*a*1 are configured to be engaged with a driving jaw 111 (refer to FIG. 9B) of the machine driving head 110 so as to receive driving force, and the opening parts 21*a*2 are configured to dodge a front end column body 112 (refer to FIG. 9B) of the machine driving head 110 and are formed between the two jaw parts 21*a*1.

Figure 10:
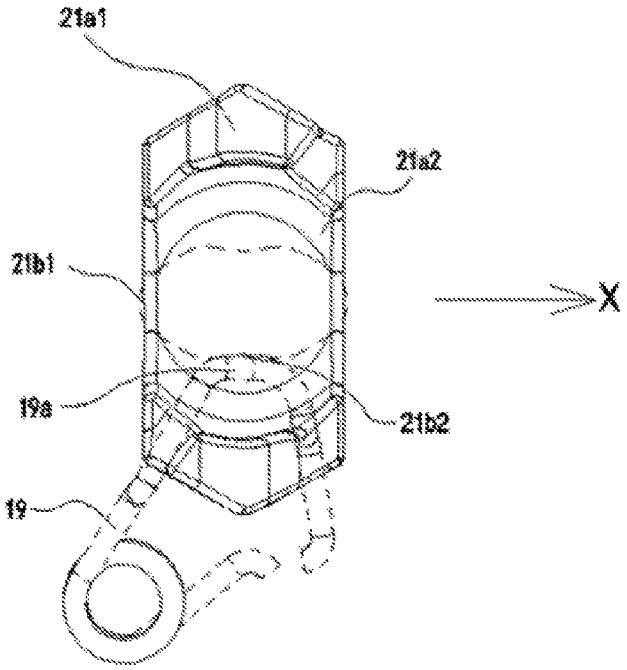
FIG. 10 is a schematic diagram showing the matching of the retaining component and the limiting part according to the present disclosure.

As shown in FIG. 7 and FIG. 10, the driving force receiver 21 includes the limiting part 21*b*, and the cross section of the driving force receiver 21 at the limiting part 21*b* is a non-circular cross section. The limiting part 21*b* comprises a protrusion part 21*b*1 and an abutment part 21*b*2, and the protrusion part 21*b*1 and the abutment part 21*b*2 extend different distances from the axis Y of the driving force receiver 21 along the radial direction of the driving force receiver 21. The abutment part 21*b*2 is configured as a plane abutting against one end 19*a* of the retaining component 19, and the protrusion part 21*b*1 is configured as a protrusion which is protruded from the radial direction of the driving force receiver 21 and has a non-circular cross section. The retaining component 19 in this embodiment is configured as a torsional spring, therefore, under the condition that the driving force receiver 21 can idle, the retaining component 19, when getting contact with the protrusion part 21*b*1, can urge the driving force receiver 21 to rotate so as to ensure that the retaining component 19 abuts against the abutment part 21*b*2. As shown in FIG. 10, when one end 19*a* of the retaining component 19 abuts against the abutment part 21*b*2, the through direction of the opening parts 21*a*2 is parallel to the mounting direction X of the process cartridge. It is a preferred embodiment in this embodiment that the through direction of the opening parts 21*a*2 is parallel to the mounting direction X of the process cartridge. In order to prevent the driving force receiving protrusion 21*a* from interfering with the front end column body 112 of the machine driving head 110, after the retaining component 19 abuts against the abutment part 21*b*2, the angle between the through direction of the opening parts 21*a*2 and the mounting direction X of the process cartridge is not 90 degrees, and at this position, it can be ensured that under the condition that the retracting stroke of the driving force receiver 21 is restricted, the jaw parts 21*a*1 of the driving force receiver 21 do not interfere with the machine driving head 110 during mounting and dismounting.

In this embodiment, the through direction of the opening parts 21*a*2 is an extension direction of the opening parts 21*a*2 between the jaw parts 21*a*1, two jaw parts 21*a*1 are arranged symmetrically. It will be appreciated by those skilled in the art that the driving force receiver 21 can also include a plurality of jaw parts, and when the driving force receiver 21 includes a plurality of jaw parts, the opening parts in this embodiment refer to opening parts formed between the two jaw parts which are engaged with a driving jaw 111 of the machine driving head.

In this embodiment, the limiting part 21*b* can be arranged on the driving force receiver 21 in a way that the driving force receiver 21 includes the limiting part 21*b* or the limiting part 21*b* is mounted on the driving force receiver 21.

When the driving force receiver 21 is in a retracting state under the action of the external force F1 of the pressing rod 31, the driving protrusions 23*b* of the second driving block 23 is disengaged from the driving force transmission protrusions 25*b* of the flange component 25, therefore, the driving force receiver 21 can idle relative to the flange component 25, and at this moment, the retaining component 19 applies a force to the limiting part 21*b* to enable the driving force receiver 21 to rotate, then the abutment part 21*b*2 rotates to abut against the retaining component 19. At this moment, the through direction of the opening parts 21*a*2 is roughly parallel to the mounting direction X of the process cartridge. Therefore, in this case, the driving force receiving protrusion 21*a* cannot interfere with the front end column body 112 of the machine driving head 110, and the process cartridge can be mounted and dismounted smoothly.

Figure 8:
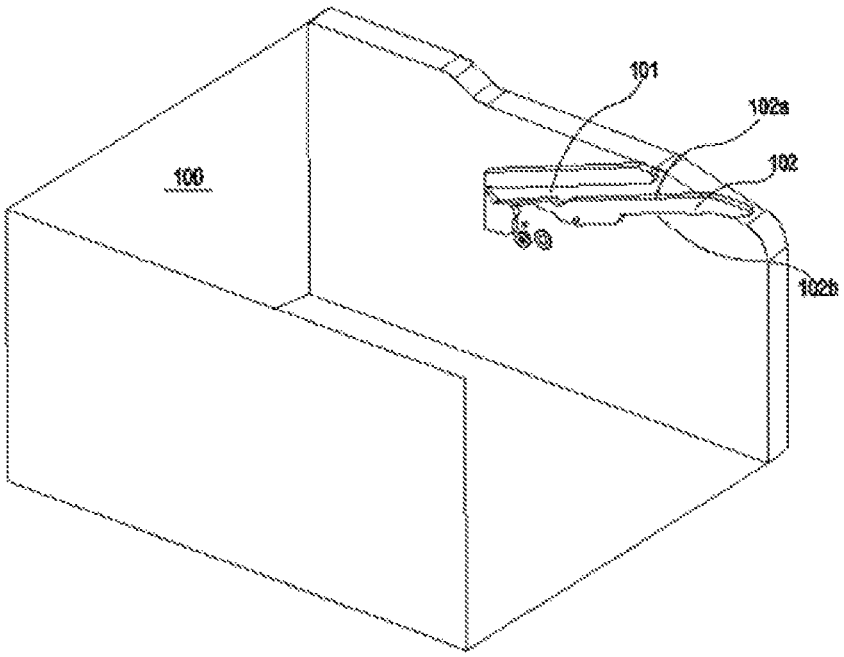
FIG. 8 is a schematic diagram of the process cartridge mounted in the image forming device according to the present disclosure.

As shown in FIG. 8, the process cartridge in the present disclosure is mounted in an image forming device 100. The image forming device 100 includes a guide groove 101 for guiding the mounting of the process cartridge, and the guide groove 101 comprises a guide rail 102 which includes an upper guide rail surface 102*a* and a lower guide rail surface 102*b*. When the process cartridge in the present disclosure is mounted into the image forming device, the ear part 41*a* of the pull rod 41 is matched with the upper guide rail surface 102*a*, and the lower guide rail surface 102*b* applies a force to the pressing rod 31.

Hereinafter, the mounting working process of the process cartridge provided by the present disclosure is described with reference to FIGS. 9A-9C.

Figure 9A:
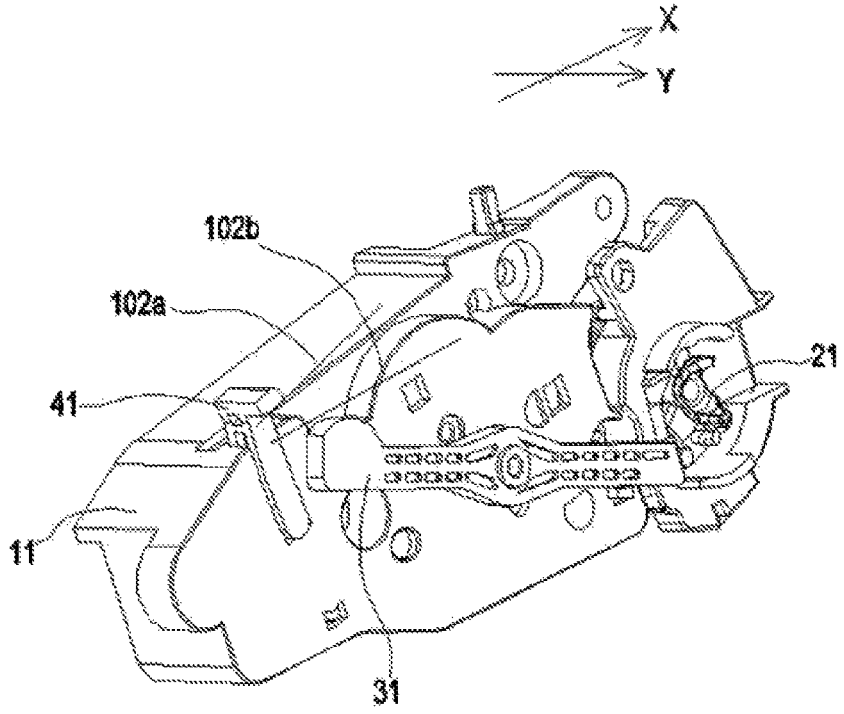
FIGS. 9A-9C are schematic diagrams showing the engagement process of the process cartridge and the driving head of the image forming device according to the present disclosure.

FIG. 9A shows that the process cartridge in the present disclosure is mounted to an initial position in the image forming device 100, and at this moment, the pull rod 41 is matched with the upper guide rail surface 102*a*, the pressing rod 31 is in an initial state and is not pressed, and the driving force receiver 21 is in an extending state.

Figure 9B:
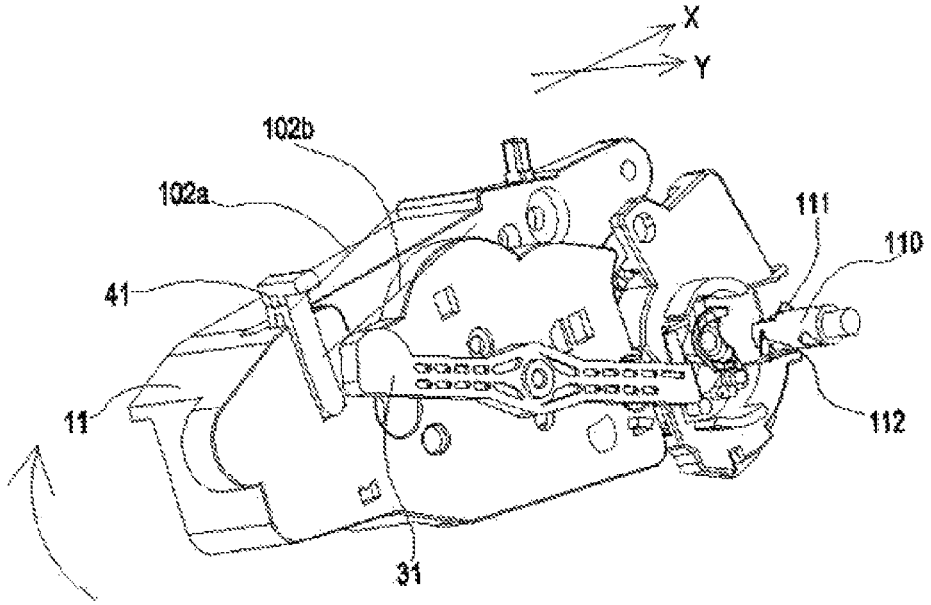

FIG. 9B shows that the process cartridge in the present disclosure is mounted to a middle position in the image forming device 100, and at this moment, the pull rod 41 acts with the upper guide rail surface 102*a* in the mounting process, the process cartridge rotates clockwise (as shown by an arrow in FIG. 9B) by taking its front end as a pivot under the action of the first elastic element 42, the rotation of the process cartridge enables the lower guide rail surface 102*b* to force and push the pressing rod 31, then the pressing rod 31 rotates around the pivot column 13 to apply a force F1 to the driving force receiver 21, and the driving force receiver 21, accordingly, retracts along its axial direction, after being in a retracting state, the driving force receiver 21 can idle relative to the flange component 25, the retaining component 19 applies a force to the limiting part 21*b* to make the driving force receiver 21 rotate, then the abutment part 21*b*2 rotates to abut against the retaining component 19, and at this moment, the through direction of the opening parts 21*a*2 is roughly parallel to the mounting direction X of the process cartridge. Therefore, the process cartridge can be mounted to a final position without interfering with the front end column body 112 of the machine driving head 110.

Figure 9C:
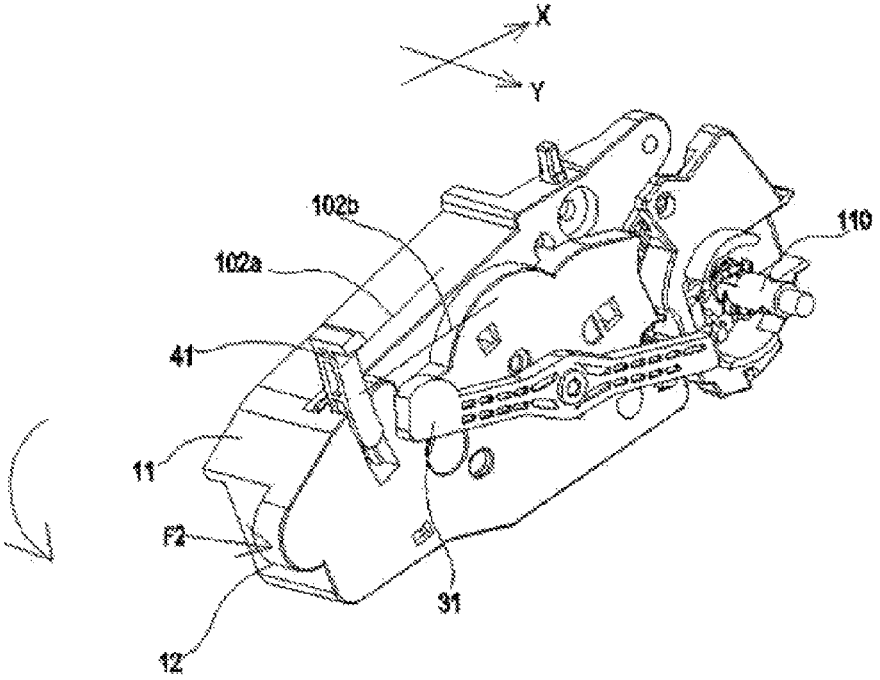

FIG. 9C shows that the process cartridge in the present disclosure is mounted to the final position in the image forming device 100. A door (not shown) of the image forming device is closed after the process cartridge is mounted to the final position, the image forming device applies a force F2 to a pressed part 12 of the process cartridge, the process cartridge rotates anticlockwise (as shown by an arrow in FIG. 9C) by taking its front end as a pivot under the action of F2, the rotation of the process cartridge enables the lower guide rail surface 102*b* to release the pressing rod 31 from urging, the driving force receiver 21 extends out under the action of the second elastic element 24 to enable the driving force receiving protrusion 21*a* to get engaged with the driving jaw 111 of the machine driving head 110, and then the driving force receiver 21 can receive a machine driving force to drive the process cartridge to work.

The dismounting process is on the contrary and will not be described in details.

Figure 12:
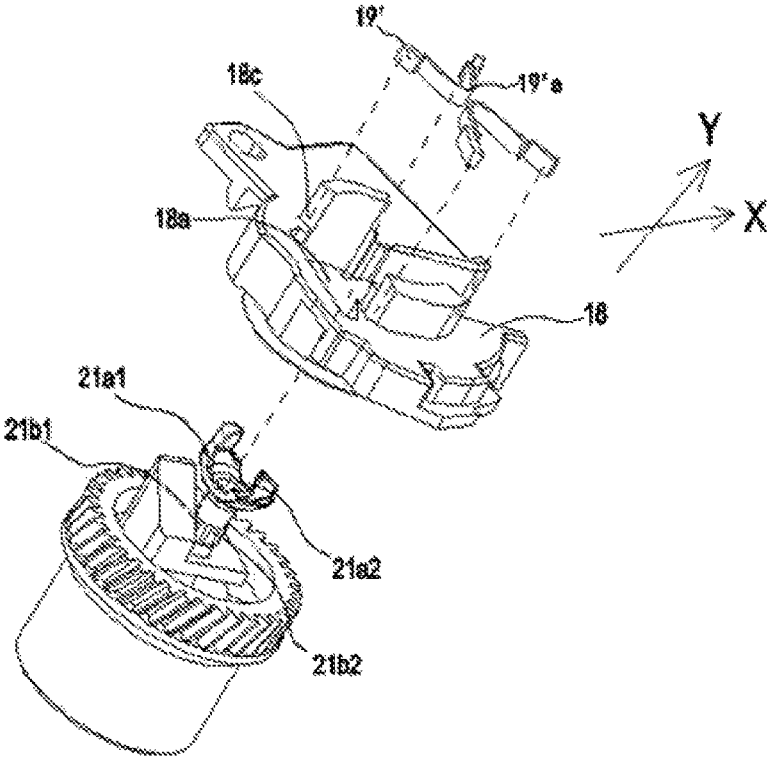
FIG. 12 is a schematic diagram of the structure of the retaining component in the second embodiment of the present disclosure.

Refer to FIG. 12, FIG. 12 is the second embodiment of the process cartridge in the present disclosure, and the differences between this embodiment and the previous embodiment lie in that: the retaining component in this embodiment is configured as steel sheets 19' which are arranged at two symmetrical positions of the holder 18. The holder 18 also includes mounting slots 18*c*, the steel plates 19' are clamped in the mounting slots 18*c*, and one tail end 19'*a* of each steel sheet abuts against the abutment part 21*b*2 of the limiting part 21*b*.

In this embodiment, the retaining component configured as steel sheets is just one embodiment, and it can also be configured as other alloy sheets, for example, zinc alloy sheets.

Figure 13:
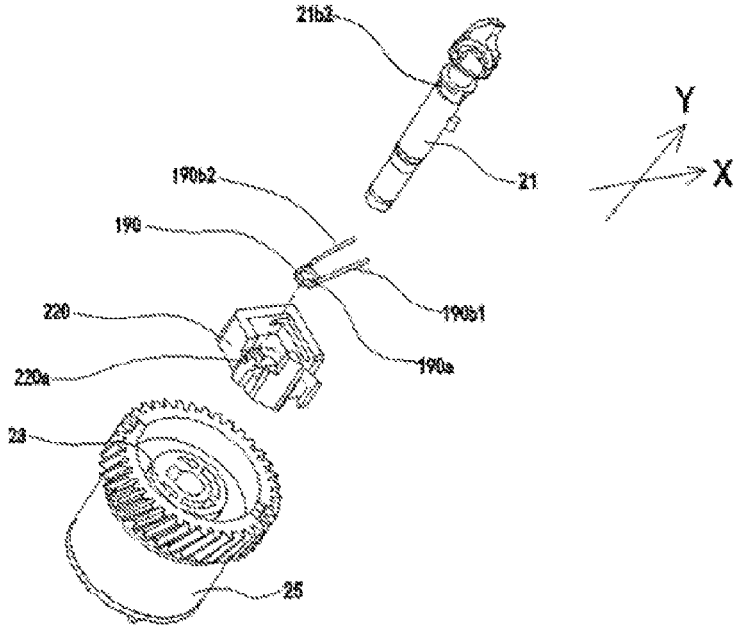
FIG. 13 is a schematic diagram of the structure of the retaining component in the third embodiment of the present disclosure.

Refer to FIG. 13, FIG. 13 is the third embodiment of the process cartridge in the present disclosure, and the differences between this embodiment and the first embodiment lie in that: the retaining component 190 in this embodiment is arranged on the first driving block 220, and includes a first end part 190*b*1 and a second end part 190*b*2 which are fixed in a mode that: the retaining component 190 includes a fixed end 190*a*, the first driving block 220 includes a fixed protrusion 220*a*, and the fixed end 190*a* is mounted into the fixed protrusion 220*a*. The retaining component 190 in this embodiment is arranged on the first driving block 220, and since the first driving block 220 retracts together with the driving force receiver 21 in the retracting process of the driving force receiver 21 and both have no relative displacement in the axial direction Y of the driving force receiver 21, the retaining component 190 cannot generate friction with the driving force receiver 21 in the axial direction of the driving force receiver 21, and the retaining component 190 includes the first end part 190*b*1 and the second end part 190*b*2 which abut against the abutment part 21*b*2 respectively at the same time. This type of configuration can avoid the situation that a partial pressure caused by single-side abutment increases the rotation torque of the driving force receiver 21.

Figure 14:
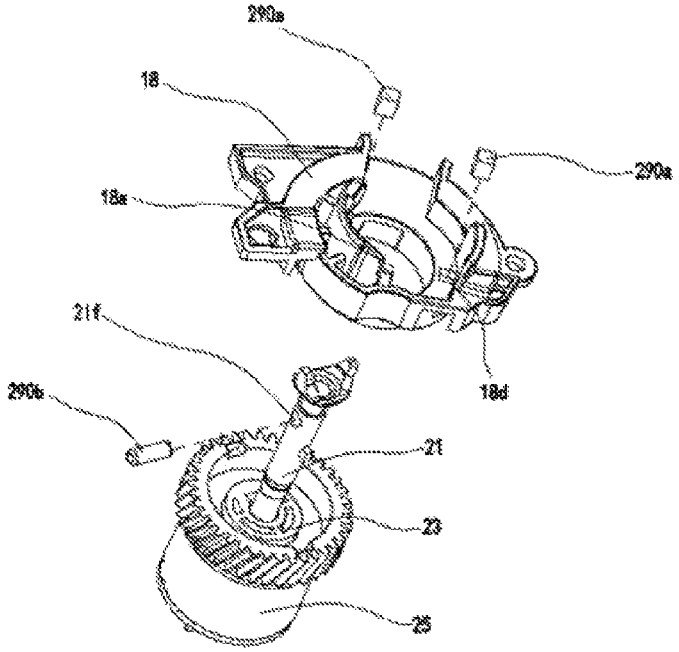
FIG. 14 is a schematic diagram of the structure of the retaining component in the fourth embodiment of the present disclosure.

Refer to FIG. 14, FIG. 14 is the fourth embodiment of the process cartridge in the present disclosure, and the differences between this embodiment and the first embodiment lie in that: the retaining component in this embodiment is configured as magnets, specifically, the holder 18 includes a first magnet 290*a*, the driving force receiver 21 includes a second magnet 290*b*, wherein the fixing mode of the two magnets optionally is that: the holder 18 includes a limiting hole 18*d*, the driving force receiver 21 includes an insertion hole 21*f*, the first magnet 290*a* is installed in the limiting hole 18*d*, and the second magnet 290*b* is installed in the insertion hole 21*f* and can rotate together with the driving force receiver 21.

Figure 15:
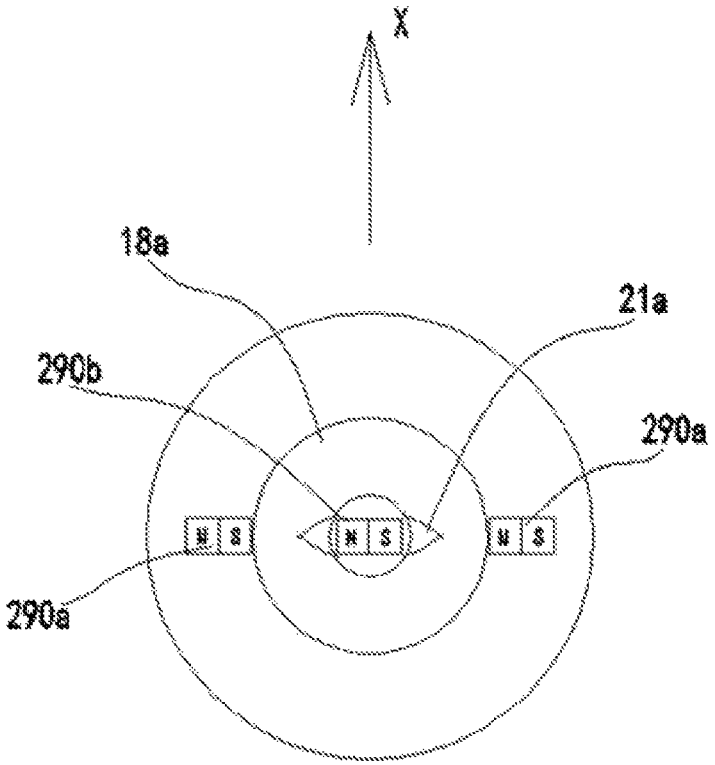
FIG. 15 is a schematic diagram showing magnet arrangement in the fourth embodiment of the present disclosure.

FIG. 15 shows a feasible way of arrangement of the magnets used as retaining components. As shown in FIG. 15, during initial configuration, the through direction of the opening parts 21*a*2 is roughly parallel to the mounting direction X, two first magnets 29*a* are fixedly arranged at two symmetrical positions of the opening 18*a* of the holder, and the second magnet 290*b* is inserted into the driving force receiver 21. The arrangement direction of N and S poles in the first magnets 290*a* and the second magnet 290*b* is perpendicular to the through direction of the opening parts 21*a*2, and with this arrangement, when the driving force receiver 21 retracts to get disengaged from the flange component 25 and can idle, the magnetic force generated between the first magnets 290*a* and the second magnet 290*b* can prevent the driving force receiving protrusion 21*a* from interfering with the front end column body 112 of the machine driving head 110 during mounting and dismounting. FIG. 15 only shows one way of arrangement of the magnets used as the retaining components. It will be appreciated by those skilled in the art that the magnets also can be arranged in other ways, there may be one first magnet 290*a* arranged, and the arrangement relationships between the through direction of the opening parts 21*a*2 and the arrangement direction of magnetic poles of the magnets and between the through direction of the opening parts 21*a*2 and the mounting direction X also may be configured in other arrangement ways.

The retaining components described in the four embodiments in the present disclosure are only part of embodiments, and it will be appreciated by those skilled in the art that the retaining component also can be arranged on other fixed parts in addition to the holder or the first driving block, and the fixed parts here refer to those which do not rotate together with the driving force receiver 21 and can fix the retaining component. The retaining component 190 in this embodiment includes a first end part 190*b*1 and a second end part 190*b*2 at the same time, and there may also be two retaining components 190, one includes a first end part, and the other one includes a second end part.

The quantity of the retaining components and the quantity of the abutment ends described in the four embodiments are only part of embodiments. It will be appreciated by those skilled in the art that there may be one or more retaining components, and each retaining component can include one or more abutment ends, wherein the retaining components in the four embodiments can be arranged on the holder or the first driving block.

In this embodiment, the control mechanism 30 is a pressing rod 31 which controls extending and retracting of the driving force receiver 21. Those skilled in the art may also adopt other control mechanisms, for example, a control mechanism disclosed in a Chinese publication patent number CN102141766B, or a control mechanism disclosed in a Chinese publication patent number CN204807923A.

The process cartridge in the present disclosure include the pull rod and the first elastic element, and the matching of the pull rod and the guide rail is used for forcing the process cartridge to rotate, so that the guide rail urges the pressing rod to control extending and retracting of the driving force receiver. Since each image forming device include a guide rail, the process cartridge is universal for each type of image forming device, and is strong in universality compared with the prior art.

The driving force receiver and the flange component of the process cartridge in the present disclosure are disengaged in a retracting state, and the retaining component is arranged at the side end of the process cartridge and the limiting part is arranged on the driving force receiver, after the retaining component is matched with the limiting part and when the driving force receiver is in a retracting state, the angle between the through direction of the opening parts of the driving force receiving protrusion and the mounting direction of the process cartridge is not 90 degrees. Therefore, the driving force receiving protrusion cannot interfere with the front end column body of the machine driving head, and the process cartridge can be mounted and dismounted more smoothly.

The embodiments above mentioned are only adopted for illustrating but not limiting the technical solution of the present disclosure; although the present disclosure is illustrated in details with reference to the above mentioned embodiments, it will be appreciated by those of ordinary skill in the art that modifications still can be made to the technical solutions recorded by the above mentioned embodiments, or equivalent substitutions can be made to part of technical characteristics therein; however, these modifications or substitutions do not make the essence of corresponding technical solutions depart from the spirit and scope of the technical solution of each embodiment in the present disclosure.

What is claimed:

1. A process cartridge, comprising:

a process cartridge housing, a photosensitive drum driving component comprising:

a driving force receiver;

a flange component, wherein the driving force receiver can transfer a driving force to the flange component to rotate the flange component;

a control mechanism, which receives external force of the image forming device to cause the driving force receiver to extend or retract;

a retaining component, which does not rotate together with the driving force receiver and the flange component when the flange component is driven for rotation, wherein the retaining component is arranged on the process cartridge and is configured to limit a stopping position of the driving force receiver in the direction of rotation of the driving force receiver when the driving force receiver is in a retracted position.

2. The process cartridge according to claim 1, wherein a limiting part abutting against the retaining component is arranged on the driving force receiver and the cross section of the limiting part is noncircular.

3. The process cartridge according to claim 2, wherein the limiting part comprises a protrusion part and an abutment part, wherein the protrusion part and the abutment part extend for different distances from the axis of the driving force receiver along the radial direction of the driving force receiver.

4. The process cartridge according to claim 3, wherein the distance which the abutment part extends from the axis of the driving force receiver along the radial direction of the driving force receiver is shorter than the distance which the protrusion part extends from the axis of the driving force receiver along the radial direction of the driving force receiver.

5. The process cartridge according to claim 4, wherein when the driving force receiver can idle relative to the flange component, the retaining component abuts against the abutment part to limit the rotary stopping position of the driving force receiver.

6. The process cartridge according to claim 1, wherein driving protrusions are arranged on the driving force receiver, driving force transmission protrusions are arranged on the flange component, and both the driving protrusions and the driving force transmission protrusions include guide inclined planes.

7. The process cartridge according to claim 6, wherein a plurality of the driving protrusions and a plurality of the driving force transmission protrusions are provided.

8. The process cartridge according to claim 6, wherein the driving force transmission protrusions extend along a direction parallel to the axial direction of the flange component.

9. The process cartridge according claim 6, wherein a first driving block and a second driving block are detachably arranged on the driving force receiver, the first driving block and the driving force receiver can rotate relative to each other, the first driving block is configured to receive a force from the control mechanism to retract the driving force receiver, the second driving block and the driving force receiver are fixed in the rotation direction, and the second driving block is configured to transfer the driving force to the flange component.

10. The process cartridge according to claim 9, wherein the plurality of the driving force transmission protrusions are arranged on the second driving block.

11. The process cartridge according to claim 1, wherein the retaining component is a torsional spring.

12. The process cartridge according to claim 11, wherein when the driving force receiver rotates, the retaining component does not rotate synchronously with the driving force receiver.

13. The process cartridge according to claim 12, wherein the process cartridge further comprises a holder, a locating column is arranged on the holder, and the retaining component is arranged on the locating column.

14. A photosensitive drum driving component, comprising:

a driving force receiver;

a flange component provided at the end of the photosensitive drum;

wherein the driving force receiver can transfer a driving force to the flange component to rotate the flange component;

wherein the driving force receiver has a first state where the driving force receiver can rotate relative to the flange component, and a second state where the driving force receiver can transfer driving force to the flange component;

the photosensitive drum driving component further comprises a retaining component, which does not rotate together with the driving force receiver and the flange component when the flange component is driven for rotation; and wherein the retaining component limits a stopping position in the direction of rotation of the driving force receiver when the driving force receiver rotates relative to the flange component.

* * * * *